US007241374B2

(12) United States Patent
Boyd et al.

(10) Patent No.: US 7,241,374 B2
(45) Date of Patent: Jul. 10, 2007

(54) PULSED ELECTRIC FIELD METHOD AND APPARATUS FOR PREVENTING BIOFOULING ON AQUATIC SURFACES

(75) Inventors: Robert C. Boyd, Richmond, VA (US); Wayne B. Legrande, Chesapeake, VA (US)

(73) Assignee: Unitech, LLC, Hampton, VA (US)

( * ) Notice: Subject to any disclaimer, the term of this patent is extended or adjusted under 35 U.S.C. 154(b) by 341 days.

(21) Appl. No.: 10/487,866

(22) PCT Filed: Oct. 29, 2002

(86) PCT No.: PCT/US02/34494

§ 371 (c)(1),
(2), (4) Date: Feb. 26, 2004

(87) PCT Pub. No.: WO03/038398

PCT Pub. Date: May 8, 2003

(65) Prior Publication Data

US 2004/0231975 A1 Nov. 25, 2004

Related U.S. Application Data

(60) Provisional application No. 60/330,679, filed on Oct. 29, 2001.

(51) Int. Cl.
*C23F 13/00* (2006.01)

(52) U.S. Cl. ..... 205/740; 205/724; 205/727; 205/728; 205/729; 204/196.37; 204/196.36; 204/196.01; 204/196.03; 204/196.05

(58) Field of Classification Search ..... 204/196.37, 204/196.36, 196.01, 196.03, 196.05; 205/740, 205/724, 727, 728, 729
See application file for complete search history.

(56) References Cited

U.S. PATENT DOCUMENTS

| | | | | |
|---|---|---|---|---|
| 5,417,820 | A * | 5/1995 | Fears | 205/729 |
| 5,643,424 | A | 7/1997 | Riffe et al. | |
| 5,820,737 | A | 10/1998 | Kohn | |
| 6,173,669 | B1 | 1/2001 | Staerzl | |
| 6,514,401 | B2 * | 2/2003 | Chyou et al. | 205/739 |
| 6,547,952 | B1 | 4/2003 | Staerzl | |

* cited by examiner

*Primary Examiner*—Bruce F. Bell
(74) *Attorney, Agent, or Firm*—Jacobson Holman PLLC

(57) ABSTRACT

An electrode system for preventing biofouling of a surface either is applied directly onto the surface of an aquatic vehicle or structure, if the surface is non-conducting; or is applied onto an insulating paint layer on the surface, if the surface is conducting; or is embedded in a layer of electrically non-conducting material. The electrode system includes two alternating sets of electrodes in the form of spaced, parallel strips made from any conductive material, preferably a conductive coating, the first set being provided with a number n of parallel electrodes, and the second set being provided with a number n−1 of parallel electrodes, with the positions of the electrodes of the first set alternating with the positions of the electrodes of the second set. The geometry of the electrodes is such that when the voltage is applied, the electric field radiates outwardly parallel to the surface of the structure. All of the electrodes of both sets preferably are of substantially equal length, and the electrodes of each set preferably are of substantially equal width. The electrodes of the first set can be the same width as the electrodes of the second set, or a different width. In a method for preventing biofouling, the electrode system is used to apply a pulsed voltage to a surface.

23 Claims, 3 Drawing Sheets

PULSED ELECTRIC FIELD METHOD AND APPARATUS FOR PREVENTING BIOFOULING ON AQUATIC SURFACES

This application claims priority to provisional U.S. Application Ser. No. 60/330,679, filed Oct. 29, 2001, which is incorporated herein by reference in its entirety.

This is a nationalization of PCT/US02/34494 filed Oct. 29, 2002 and published in English.

FIELD OF THE INVENTION

The invention relates to a method of using short pulses of electricity carried through a conductive material, preferably a conductive coating to create an electric field, which has a preventative effect on the settling of aquatic nuisance species, and apparatus for carrying out the method.

BACKGROUND OF THE INVENTION

The prevention of biofouling on the hulls of ships is presently achieved by means of toxic paints. Regulations on the use of these paints, due to the leach rates of pesticide materials into the aquatic environment, will force shipbuilders and ship owners to search for alternative methods for the prevention of fouling. One environmentally friendly alternative is to use electricity. From scientific literature it is known that even small electric fields prevent the growth of aquatic nuisance species on surfaces. This method has previously not been applied to ships due to the belief that biofouling prevention with small electric fields requires the application of a continuous voltage source. Even for small voltages, the energy dissipation would be to high for this system to be affordable for the average ship application. A second factor is that in previous experimental studies, the surface to be protected was one of the two electrodes required to form a circuit. In the case of a ship, it would require a second electrode shell to be placed around the hull of the ship to supply a uniform field distribution. This would require major modifications to the design of the ship.

It is to the solution of these and other problems that the present invention is directed.

BRIEF SUMMARY OF THE INVENTION

It is therefore an object of the present invention to provide a biofouling prevention method and apparatus that is environmentally friendly.

It is another object of the present invention to provide a biofouling prevention method and apparatus that uses electricity.

These and other objects of the invention are achieved by the provision of an electrode system, which either is applied directly onto the surface of a ship, vessel, or other aquatic vehicle or structure, if the surface is electrically non-conductive; or is applied onto an insulating paint, polymer or composite layer on the surface of a ship, vessel, or other aquatic vehicle or structure, if the surface is electrically conductive. The electrode system comprises two sets of electrodes made from any conductive material, preferably a conductive coating. The geometry of the sets of electrodes is such that when the voltage is applied, the electric field radiates outwardly parallel to the surface of the structure and allows for the protection of a large surface area with relatively minor changes in the design of the ship hull or other aquatic structure.

In one aspect of the invention, the electrodes can be embedded in the outer layer of a gel coat of a fiber reinforced plastic or composite, or embedded in a polymer matrix of an outer layer of a ship, vessel or any aquatic structure.

In another aspect of the invention, the electrodes are in the form of strips, the first set being provided with a number n of parallel electrodes, the second set being provided with a number n-1 of parallel electrodes, with the positions of the electrodes of the first set alternating with the positions of the electrodes of the second set.

In still another aspect of the invention, all of the electrodes of both the first and second sets are of substantially equal length, the electrodes of the first set are of substantially equal width, and the electrodes of the second set are of substantially equal width. The electrodes of the first set can be the same width as the electrodes of the second set, or a different width.

A method for preventing biofouling in accordance with the invention comprises using the electrode system to apply a pulsed voltage to a surface. In one aspect of the invention, the pulsed voltage has an amplitude of at least about 1 volt, and preferably between about 1 volt and about 1000 volts, the pulse duration is between about 100 nanoseconds and about 800 nanoseconds, and the pulse repetition rate is between about 1 pulse per second and about 50 pulses per second.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE INVENTION

Figure 1A:
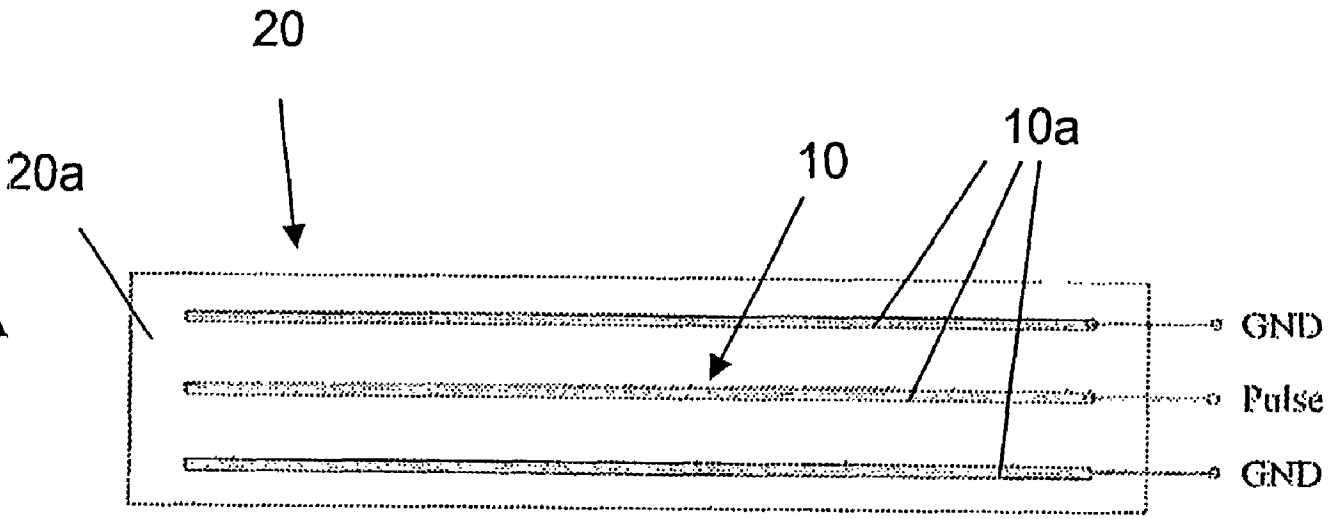
FIG. 1A is an elevational view of a front of a test panel incorporating electrodes in accordance with one embodiment of the invention.

In describing preferred embodiments of the present invention illustrated in the drawings, specific terminology is employed for the sake of clarity.

However, the invention is not intended to be limited to the specific terminology so selected, and it is to be understood that each specific element includes all technical equivalents that operate in a similar manner to accomplish a similar purpose.

The invention is based on the principal that short pulses of electricity have a preventative effect on the settling of aquatic nuisance species. Pulse technology allows for the generation of efficient electric pulses of less than one millionth of a second (one microsecond) duration. The application of one microsecond pulse once every second would achieve the same effect as continuous electric power, but the energy consumption and the energy cost would be reduced by a factor of one million.

Figure 1B:
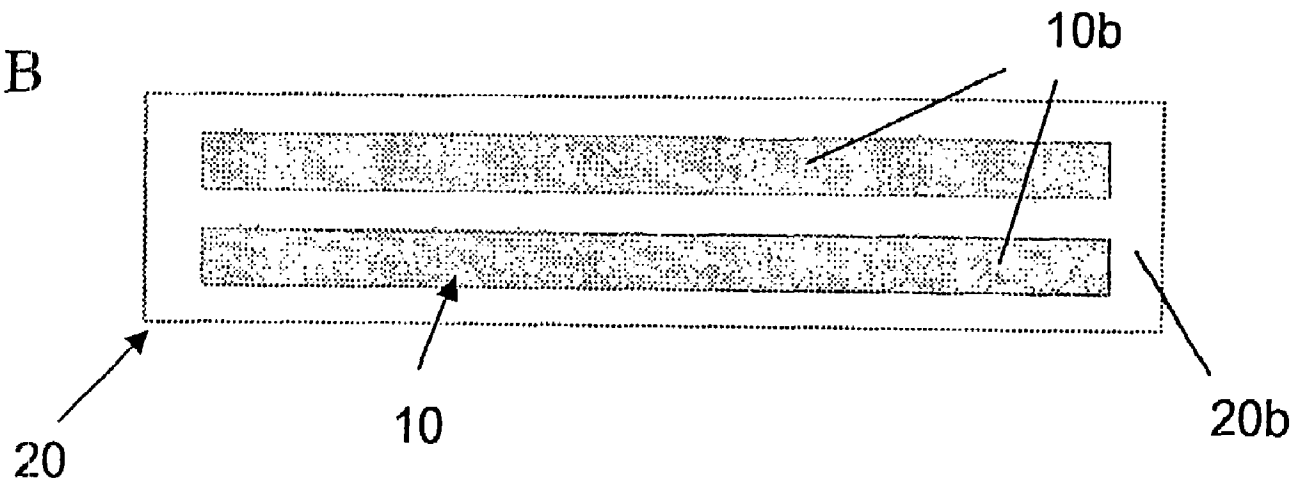
FIG. 1B is an elevational view of the back of the test panel of FIG. 1A.

The application of short pulses of electricity is achieved through the provision of an electrode system, that either is applied directly onto the surface of a ship, vessel, or other aquatic vehicle or structure, if the surface is electrically non-conductive; or is applied onto an insulating paint layer on the surface of a ship, vessel, or other aquatic vehicle or structure, if the surface is electrically conductive. Referring now to FIGS. 1A and 1B, there is shown embodiment of an electrode system 10 in accordance with the present invention, applied to the front and back surfaces 20*a* and 20*b* of a panel 20 representing the surface of a ship, vessel, or other aquatic vehicle or structure. The electrode system 10 comprises alternating first and second sets of electrodes 10*a* and 10*b* made from any conductive material, preferably a conductive coating. The geometry of the electrodes 10*a* and 10*b*is such that when the voltage is applied, the electric field radiates outwardly parallel to the surface 20*a* of the structure 20 and allows for the protection of a large surface area with relatively minor changes in the design of the ship hull or other aquatic structure.

In the embodiment shown in FIGS. 1A and 1B, the front surface 20*a* of the panel 20 is provided with a number n of alternating ground and pulse electrodes 10*a* in the form of parallel strips (in the embodiment of FIGS. 1A and 1B, three parallel strips) formed of a conductive coating, While the other surface 20*b* of the panel 20 is provided with a number n-1 of pulse electrodes 10*b* in the form of parallel strips (in the embodiment of FIGS. 1A and 1B, two parallel strips) formed of the same conductive coating, where n is at least two. The positions of the electrodes 10*a* on the front surface 20*a* alternate with the positions of the electrodes 10*b* on the other surface 20*b*. The actual number of electrodes 10*a* and 10*b* will vary depending upon the size of the surface to be covered by the electric field radiating from the electrodes. It is contemplated that the minimum number 77 of electrodes 10*a* in the first set is two (a single ground electrode and a single pulse electrode), so that the minimum number n-1 of electrodes 10*b* in the second set is one (a single pulse electrode). All of the electrodes 10*a* and 10*b* on both sides 20*a* and 20*b* of the panel 20 are of substantially equal length, the electrodes 20*a* on the front surface 20*a* are of substantially equal width, and the electrodes 20*b* on the back surface 20*b* are of substantially equal width. The electrodes 20*a* on the front surface 20*a* can be the same width as the electrodes 20*b* on the back surface 20*b*, or (as shown in FIGS. 1A and 1B) a different width.

The separation-between the sets of electrodes 10*a*and 10*b* allows the field radiating to cover the entire aquatic surface. It is believed by the inventors that the higher the voltage that is applied to the electrodes 10*a* and 10*b*, the larger the separation can be between the electrodes 10*a* and 10*b*, and thus the larger the electric field radiating from the electrodes and the area that can be protected by the invention.

The electrodes 10*a* and 10*b* are made from any conductive material, preferably a conductive coating, and preferably the UNISHIELD® conductive coating composition disclosed in U.S. application Ser. No. 09/151,445, filed Sep. 11, 1998, which is incorporated herein by reference in its entirety (hereafter, "the original UNISHIELD® conductive coating composition"); or a composition that is an improvement of the original UNISHIELD® conductive coating composition (hereafter, "the improved UNISHIELD® conductive coating composition), which is also the invention of the present inventors, Robert C. Boyd and Wayne B. LeGrande.

The original UNISHIELD® conductive coating composition disclosed in U.S. application Ser. No. 09/151,445 comprises an emulsion polymer binder, which is a blend of a first emulsion containing a conjugated diene monomer or comonomer, and a second emulsion containing an acrylic polymer. It also contains an effective amount of electrically conductive particles dispersed in the binder, and water as a carrier. The electrically conductive particles include a combination of graphite particles and metal-containing particles, the graphite particles preferably being natural flake graphite and the metal-containing particles preferably being silver or nickel containing particles.

In the improved UNISHIELD® conductive coating composition, the second emulsion of the polymer binder can be selected from any of an acrylic, aliphatic or aromatic polyurethane, polyester urethane, polyester, epoxy, polyamide, polyimide, vinyl, modified acrylic, fluoropolymer, and silicone polymer, or a combination thereof. Also, in the improved UNISHIELD® conductive coating composition, the electrically conductive particles can be selected from any of graphite particles, carbon nanotubes, and metal containing particles, or a combination thereof The graphite particles are preferably natural flake graphite. The carbon nanotubes are preferably 10 to 60 nanometers in diameter and from less than 1 micron to 40 microns in length. The metal containing particles are preferably silver or nickel containing particles; however, other metals may also be employed such as gold, platinum, copper, aluminum, iron or iron compounds and palladium. The metal containing particles are more preferably metal coated ceramic microspheres or metal coated ceramic fibers; however, other metal coated particles may also be employed such as metal coated glass flake, glass spheres, glass fibers, boron nitride powder or flake and mica flakes.

The conductive coating can be applied via a variety of methods including but not limited to spraying, for example using conventional spray technology; brushing; roll coating; dip application; and flow coating.

In the embodiment of FIGS. 1A and 1B, the panel 20 is made of an electrically non-conductive material, so that an insulating layer is not required between the sets of electrodes 10*a* and 10*b*and the front and back surfaces 20*a* and 20*b*, respectively. The placement of the sets of electrodes 10*a* and 10*b* is not limited to opposite surfaces of a structure. The sets of electrodes 10*a* and 10*b* can be embedded in the same or separate, spaced layers of an electrically non-conductive material or applied to the same surface of an electrically non-conductive material, as long as the sets of electrodes 10*a* and 10*b* are insulated from each other by the electrically non-conductive material. For example, the sets of electrodes 10*a* and 10*b* can be embedded in the outer layer of a gel coat of a fiber reinforced plastic or composite, or embedded in a polymer matrix of an outer layer of a ship, vessel or any aquatic structure A field study of the apparatus and method in accordance with the present invention was performed in tidal water of the Atlantic Ocean in the Virginia Beach geographical area. Four acrylic polymer (Plexiglas®) panels were chosen as the test substrate, so that an insulating layer was not required between the electrodes and the surfaces of the panels. The geometry of the electrode systems is shown in FIGS. 2 and 3.

To form the electrodes, three of the panels (PI, PIII, and PIV were coated on the front surface 20*a* with three electrodes 10*a* formed of strips of the original UNISHIELD® conductive coating composition, 80 mm in length and 4 mm wide. The separation between the electrodes 10*a* was 49 mm. The reverse (back) surfaces 20*b* of three of the panels (PI, PIII, and PIV) had two electrodes 10*b* formed of strips of the original UNISHIELD® conductive coating composition, 80 mm in length, 49 mm wide, with a separation of 12.7 mm between the electrodes 10*b*. The electrodes 10*a* and 10*b* on both the front and back surfaces 20*a* and 20*b* had a dry film thickness of about 3–4 mils. The resistivity for the original UNISHIELD® conductive coating composition was 120–150 Ω per electrode or 1.5–1.9 Ωcm. The electrodes 10*a* and 10*b* were connected to a pulsed voltage source (not shown), which for the field study provided pulses of 750 nanoseconds with a repetition rate of one pulse per second. The amplitude of the voltage pulse was 100 volts. However, it is contemplated that in the method in accordance with the present invention, the pulse duration will be between about 100 nanoseconds and about 800 nanoseconds, the pulse repetition rate will be between about 1 pulse per second and about 50 pulses per second, and the amplitude of the voltage pulse will be at least about 1 volt, and preferably between about 1 volt and about 1000 volts.

Figure 2:
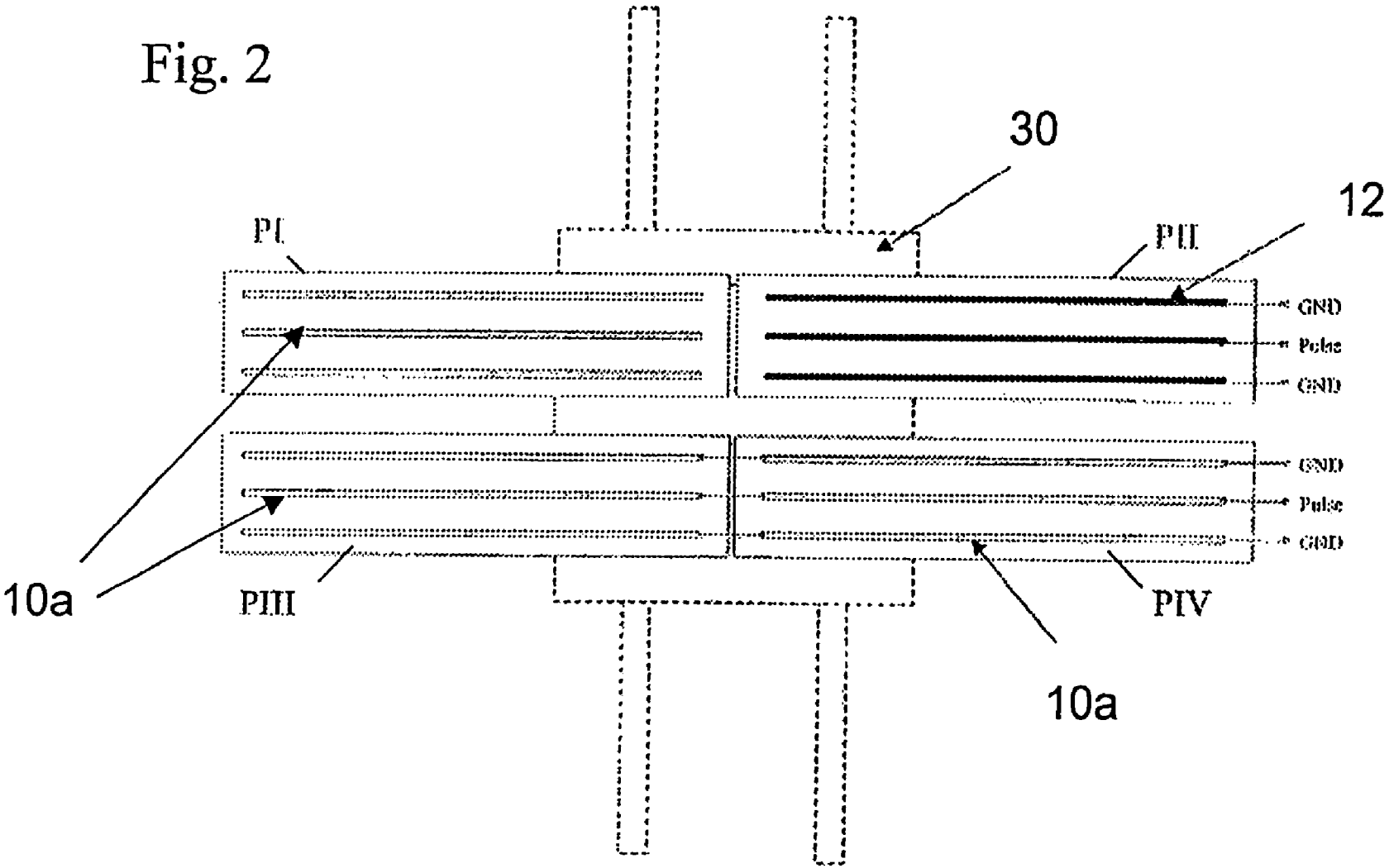
FIG. 2 is an elevational view of the front of an arrangement of two control panels and two test panels.
Figure 3:
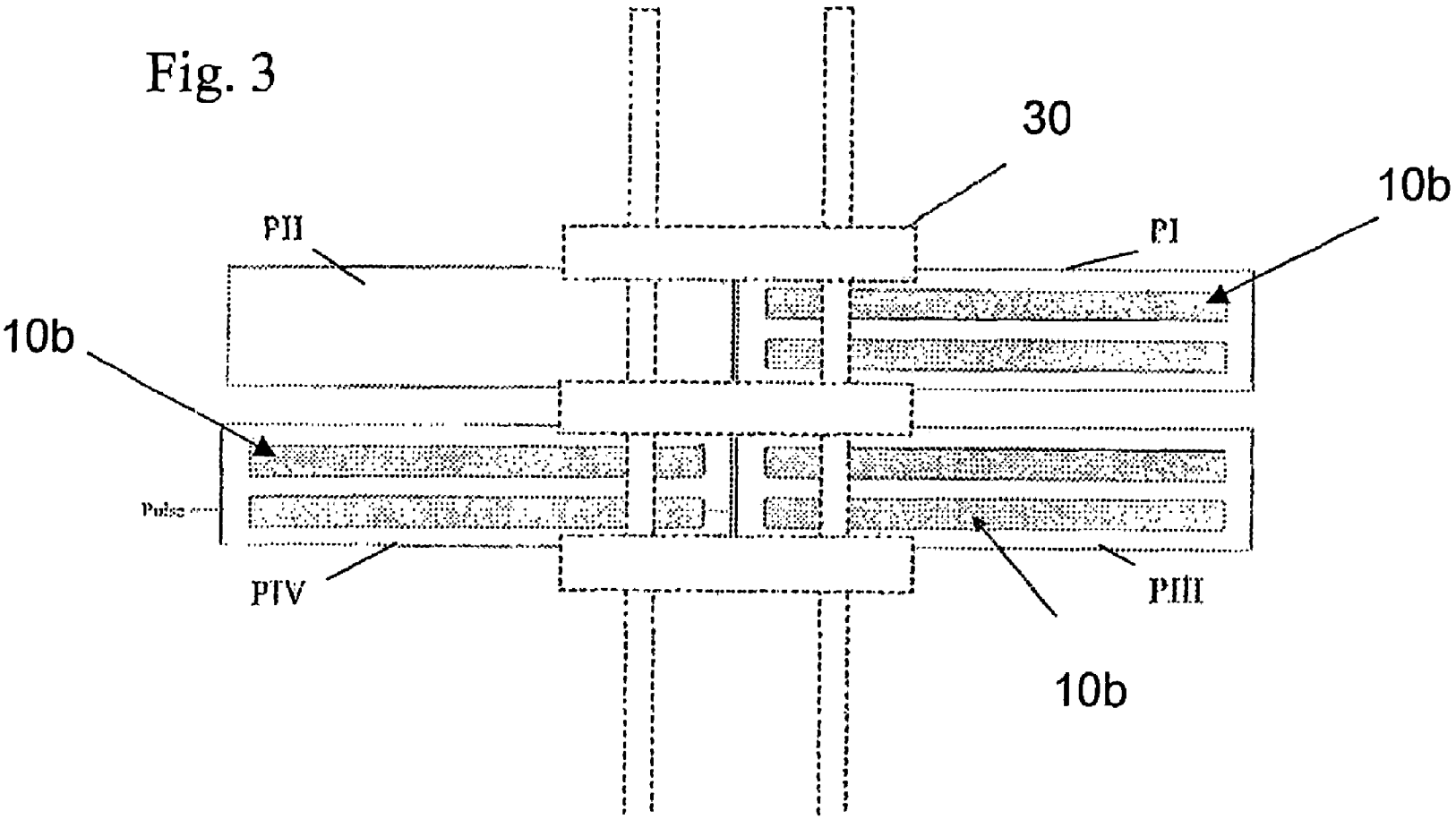
FIG. 3 is an elevational view of the back of the arrangement of FIG. 2.

The four panels PI, PII, PIII, and PIV were arranged on a panel holder 30 as seen in FIG. 2, with one panel (panel PI) being a control and having first and second sets of electrodes 10*a* and 10*b* in accordance with the invention as shown in FIGS. 1A and 1B but with no electrical pulsing applied; another panel (panel PII) being a control with electrodes 12 made of conventional wire; and the remaining two panels (panels PIII and PIV) having first and second sets of electrodes 10*a* and 10*b* in accordance with the invention as shown in FIGS. 1A and 1B, with a pulsed voltage applied. FIG. 3 shows the backside of the panels PI, PII, PIII, and PIV.

From the preliminary measurements, the upper limit of energy expenditure for biofouling protection can be estimated to be less than 20 m $W/m^2$ [electric field (10 V/cm)× current density (0.2 $\lambda cm^3$ for sea water)×estimated thickness of current carrying water layer (1 cm)×pulse duration (700 nanoseconds)×repetition frequency (1 cps)]. For a hull of 200 m in length and 20 m in height, the total energy expenditure adds up to approximately 120 W of electricity.

After six weeks immersion, the pulsed panels (PIII and PIV) did not show signs of biofouling. They exhibited a thin layer of slime that could be easily removed. The panel with the wire electrode (PII) showed a small amount of fouling, which can be attributed to the fact that the wire electrodes 12 corroded and failed at some point during the experiment. The control panel (PI) exhibited barnacle growth. The panel holder 30 and framing device (not shown) also exhibited strong barnacle growth.

Modifications and variations of the above-described embodiments of the present invention are possible, as appreciated by those skilled in the art in light of the above teachings. For example, variations in the voltage will change the electrical radiation pattern from the electrode system. The electrical radiation pattern will also be affected by the width and length of the electrode system. Other variations can include the pulse duration and the repetition rate for the pulsing. The variations can be employed to determine the optimum electrical requirements to effectively prevent fouling on a particular substrate or vessel. The variations can also be used to determine the most effective requirements based on the conditions of a particular body of water, where certain geographical areas are known to produce a higher density of fouling. It is therefore to be understood that, within the scope of the appended claims and their equivalents, the invention may be practiced otherwise than as specifically described.

We claim:

1. An electrode system for preventing biofouling of a surface, comprising first and second alternating sets of electrodes made from a conductive material, the electrodes having a geometry and placed in relation to the surface such that when a voltage is applied, an electric field is created that radiates outwardly substantially parallel to the surface, said first set of electrodes including a number n of parallel strips, the second set of electrodes including a number n−1 of parallel strips, the electrodes of the first set having a different width than the electrodes of the second set, and positions of the electrodes of the first set alternating with positions of the electrodes of the second set.

2. The electrode system of claim 1, wherein the conductive material is a conductive coating.

3. The electrode system of claim 2, wherein the surface is electrically non-conductive, and wherein the conductive coating forming the electrodes is applied directly onto the surface.

4. The electrode system of claim 2, wherein the surface is electrically conductive, and wherein the conductive coating forming the electrodes is applied onto an insulating layer selected from the group consisting of paint, polymer, and composite.

5. The electrode system of claim 1, wherein all of the electrodes of both the first and second sets are of substantially equal length, the electrodes of the first set are of substantially equal width, and the electrodes of the second set are of substantially equal width.

6. An electrode system for preventing biofouling of a surface, comprising first and second alternating sets of electrodes made from a conductive material forming a conductive coating, the electrodes having a geometry and placed in relation to the surface such that when a voltage is applied, an electric field is created that radiates outwardly substantially parallel to the surface, said conductive coating being a composition including an emulsion polymer binder, an effective amount of electrically conductive particles dispersed in the binder, and water as a carrier, said electrically conductive particles including a combination of graphite particles and metal-containing particles.

7. The electrode system of claim 6, wherein the graphite particles are natural flake graphite and the metal-containing particles are silver or nickel containing particles.

8. The electrode system of claim 6, wherein the metal-containing particles are selected from the group consisting of silver containing particles and nickel containing particles.

9. The electrode system of claim 6, wherein the metal-containing particles are selected from the group consisting of silver containing particles, nickel containing particles, gold containing particles, platinum containing particles, copper containing particles, aluminum containing particles, iron containing particles, iron compound containing particles, and palladium containing particles.

10. The electrode system of claim 9, wherein the metal containing particles are selected from the group consisting of metal coated ceramic microspheres, metal coated ceramic fibers, metal coated glass flake, metal coated glass spheres, metal coated glass fibers, metal coated boron nitride powder, metal coated boron nitride flake, and metal coated mica flakes.

11. An electrode system for preventing biofouling of a surface, comprising first and second alternating sets of electrodes made from a conductive material forming a conductive coating, the electrodes having a geometry and placed in relation to the surface such that when a voltage is applied, an electric field is created that radiates outwardly substantially parallel to the surface, said said conductive coating being a composition including an emulsion polymer binder, an effective amount of electrically conductive particles dispersed in the binder, and water as a carrier, said binder being a blend of a first emulsion containing a conjugated diene monomer or comonomer, and a second emulsion containing a polymer.

12. The electrode system of claim 11, wherein the polymer is an acrylic polymer.

13. The electrode system of claim 11, wherein the polymer is selected from the group consisting of acrylic polymer, epoxy, polyamide, polyimide, urethane, vinyl acrylic, styrenated acrylic, and silicone.

14. The electrode system of claim 11, wherein the polymer is selected from any of an acrylic, aliphatic or aromatic polyurethane, polyester urethane, polyester, epoxy, polyamide, polyimide, vinyl, modified acrylic, fluoropolymer, and silicone polymer, or a combination thereof.

15. The electrode system of claim 11, wherein the electrically conductive particles are selected from any of graphite particles, carbon nanotubes, and metal containing particles, or a combination thereof.

16. An electrode system for preventing biofouling of a surface, comprising first and second alternating sets of electrodes made from a conductive material, the electrodes having a geometry and placed in relation to the surface such that when a voltage is applied, an electric field is created that radiates outwardly substantially parallel to the surface, said electrodes being embedded in an outer layer of a gel coat of a material selected from the group consisting of a fiber reinforced plastic and a fiber reinforced composite.

17. An electrode system for preventing biofouling of a surface, comprising first and second alternating sets of electrodes made from a conductive material, the electrodes having a geometry and placed in relation to the surface such that when a voltage is applied, an electric field is created that radiates outwardly substantially parallel to the surface, said electrodes being embedded in a polymer matrix of an outer layer of a structure.

18. A method of preventing biofouling of a surface comprising:

providing an electrode system on the surface, said electrode system including first and second alternating sets of electrodes made from a conductive material, said electrodes having a geometry and placed in relation to the surface such that when a voltage is applied, an electric field is created that radiates outwardly substantially parallel to the surface; and applying a pulsed voltage to said electrodes, the pulsed voltage having an amplitude of at least about 1 volt, the pulse duration being between about 100 nanoseconds and about 800 nanoseconds, and the pulse repetition rate being between about 1 pulse per second and about 50 pulses per second.

19. The method of claim 18, wherein the pulsed voltage has an amplitude of between about 1 volt and about 1000 volts.

20. The method of claim 18, wherein the surface is electrically non-conductive, and wherein said providing step comprises applying the conductive coating forming said electrodes directly onto the surface.

21. The method of claim 18, wherein the surface is electrically conductive, and wherein said providing step comprises applying the conductive coating forming said electrodes onto an insulating layer selected from the group consisting of paint, polymer, and composite.

22. A method of preventing biofouling of a surface comprising:

providing an electrode system on the surface, said electrode system including first and second alternating sets of electrodes made from a conductive material, said electrodes having a geometry and placed in relation to the surface such that when a voltage is applied, an electric field is created that radiates outwardly substantially parallel to said surface, said electrodes being embedded in an outer layer of a gel coat of a material selected from the group consisting of a fiber reinforced plastic and a fiber reinforced; and applying a pulsed voltage to said electrodes.

23. A method of preventing biofouling of a surface comprising:

providing an electrode system on the surface, said electrode system including first and second alternating sets of electrodes made from a conductive material, said electrodes having a geometry and placed in relation to the surface such that when a voltage is applied, an electric field is created that radiates outwardly substantially parallel to said surface, said electrodes being embedded in a polymer matrix of an outer layer of a structure; and applying a pulsed voltage to said electrodes.

* * * * *